United States Patent [19]

Ferenczi

[11] Patent Number: 4,759,737

[45] Date of Patent: Jul. 26, 1988

[54] DOLL HAVING PNEUMATIC ACTUATED ARMS

[76] Inventor: Magda Ferenczi, 395 Paul Ct., West Hempstead, N.Y. 11552

[21] Appl. No.: 24,388

[22] Filed: Mar. 11, 1987

[51] Int. Cl.[4] ..... A63H 3/06

[52] U.S. Cl. ..... 446/183; 446/198

[58] Field of Search ..... 446/183, 185, 198, 184, 446/199, 226

[56] References Cited

U.S. PATENT DOCUMENTS

| | | | |
|---|---|---|---|
| 1,547,354 | 7/1925 | Baum | 446/185 |
| 3,141,261 | 7/1964 | Mirando | 446/185 |
| 4,067,138 | 1/1978 | Cederholm et al. | 446/183 |
| 4,287,681 | 9/1981 | Albert et al. | 446/183 |
| 4,583,957 | 4/1986 | Levy | 446/183 X |

*Primary Examiner*—Mickey Yu

*Attorney, Agent, or Firm*—Nicholas J. Garofalo

[57] ABSTRACT

The invention provides a doll the arms of which are movable caressingly over the body of a child when the doll is held to the chest of the child with its arms about the sides of the child and when manual pressure is applied over the back of the doll. A compressible resilient sealed air filled container is disposed in the doll's body and has resilient flexible tubes sealed at their free ends and extending into the doll's arms. Upon the container being compressed under manual pressure applied over the back of the doll, air is pressured into the tubes causing the arms to caressingly move over the sides of the child. The arms and container relax upon release of the pressure.

5 Claims, 1 Drawing Sheet

DOLL HAVING PNEUMATIC ACTUATED ARMS

BACKGROUND OF THE INVENTION

This invention relates to dolls. It is more particularly concerned with the provision of a doll capable of effecting a caressing or gentle stroking action upon a person holding the doll so as to impart to the person a feeling of love and affection.

Children, especially small girls, have always cherished dolls as their favorite toys. To a child a doll is a companion, a source of love, and as having a power of soothing a hurt, drying away tears and restoring a smile.

These benefits are of considerable value to a child. We also know that an affectionate caress or gentle stroke can give much added comfort and a feeling of love.

Accordingly, a general object of this invention is to provide a doll which provides not only the customary joys for a child, but is also capable of giving an added delight, that is, an affectionate caress.

A more particular object of the invention is to provide a doll having arms adapted, while the doll is held, to be moved to impart to the holder an affectionate caress.

Another object of the invention is to provide a soft-bodied doll embodying a sealed soft container filled with air having tubes extending through the doll's shoulders into and down its arms to the bottoms of the forearms, wherein the container is compressible under manual pressure applied to the back of the doll to pressure the air in the tubes and thereby force the arms to move relative to the body of the doll, and wherein the tubes and arms are responsive to relaxing of the pressure to restore to normal with the container.

BRIEF SUMMARY OF THE INVENTION

In accordance with the invention, a doll is provided having a stuffed compressible and resilient body, and having similarly stuffed arms which extend from the shoulders downwardly and in front of its body. A compressible and resilient soft container filled with air is disposed in the body of the doll. It has a pair of soft resilient flexible tubes extending from its sides through the shoulders of the doll and into the arms of the doll. The tubes open at one end into opposite sides of the container and are sealed at their opposite ends. The container is sealed against escape of air to the outside. The doll is of a size and the arms are such that the arms may be flexed to extend about the sides of the child's body when the doll is held against the child's chest. In this position the arms of the doll may be caused to move over the body of the child in the manner of a caress or gentle stroking. This may be done when the child exerts manual pressure on the back of the doll over the container. The pressure serves to swell and move the arms upwardly over the body of the child; and as the pressure is relaxed, the arms move back to normal.

The foregoing features, objects and advantages of the invention, as well as others, will become increasingly apparent as this specification proceeds in further detail and as it is read in conjunction with the accompanying drawing, wherein an embodiment of the invention is illustrated.

DETAILED DESCRIPTION OF THE INVENTION

Figure 1:
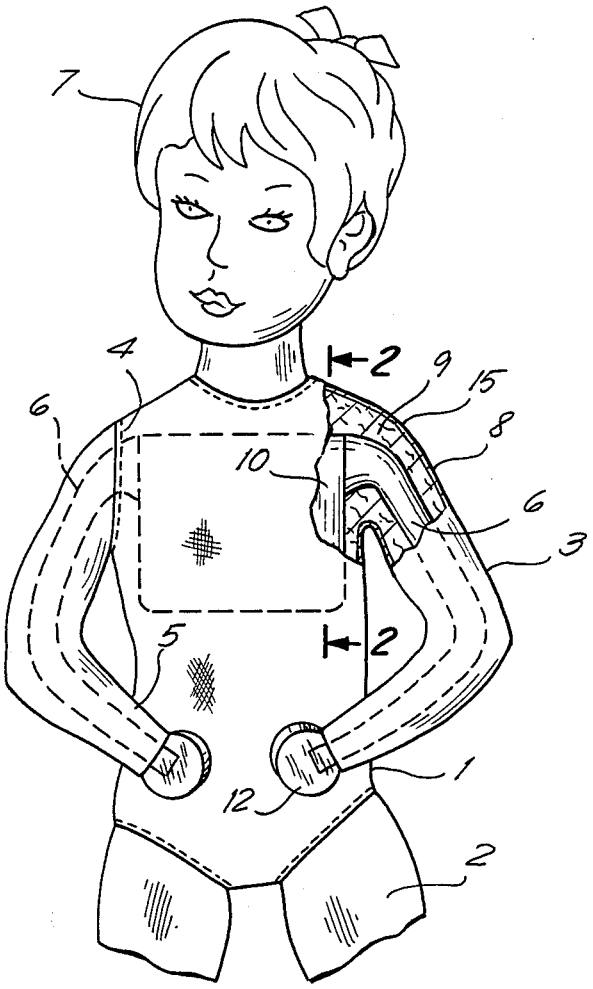
FIG. 1 is a front elevational view of a doll embodying the invention and showing the arms of the doll as depending downward with the forearms in front of the doll.
Figure 2:
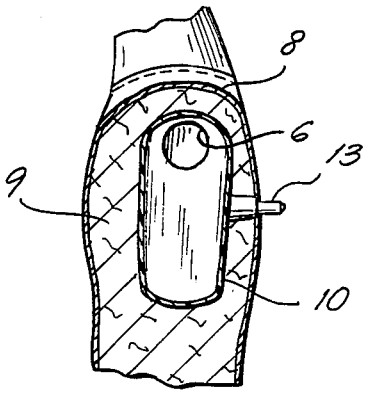
FIG. 2 is a section on line 2—2 of FIG. 1.

Reference is now directed to the several FIGURES of the drawing. The doll has a trunk or body 1. A pair of legs 2 are appended to the lower end of the body. A pair of arms 3 are attached, as by stitching 4, to the shoulders 15 and extend downward. The arms have a normal position in which the forearms 5 front the body, as appears in FIG. 1. This normal position of the forearms is obtained by resilient flexible tubes 6 within the arms. Secured to a neck end of the body is a doll's head 7.

The body 1 is intended to be compressible under manual pressure and to have a resilience whereby it will restore to normal upon the pressure being relaxed. To this end, it has a soft outer covering or skin 8, preferably of cloth or plastic material. The skin covers over stuffing 9 of soft material filling the interior of the body. A filling of cloth fragments or sponge material is suitable for this purpose. The arms have a similar outer skin or covering and interior filling.

Within the body of the doll and held in position therein by the stuffing is a pouch or container 10. Here; the container is shown as being of box or pillow form. A pair of tubes 6, integral with the container, extend from the upper ends of opposite sides thereof. Each tube extends from the container through one of the shoulders of the body into a separate one of the arms, preferably to the end of the forearm and partly into the hand 12. The tubes open at their upper ends into the upper ends of the container, so that air filling the container to capacity similarly fills the tubes. The tubes are sealed at their free ends against escape of the air; and the container is sealed against escape of its air to the outside. The tubes have a normal position in which they curve in their lower portions to front the body of the doll, whereby the forearms 5 of the doll also obtain this position. A valve element 13, fitted to the back of the container and projecting through the rear of the doll, serves as a means through which air may, when needed, be pumped to maintain an air filled condition of the container and tubes.

The container and tubes are formed of soft resilient flexible material, such as rubber or plastic. The container and tubes are such that, upon the air filled container being manually squeezed or compressed, air forced from the container flows into and pressurizes the tubes. This causes the tubes and arms to stiffen or swell radially and also to move relative to the body of the doll. In this respect, the arms move directionally upwardly relative to the body of the doll. This movement of the arms is stronger when the container is abruptly or sharply compressed. The container and arms restore to normal as pressure on the container is relaxed.

This desirable and beneficial movement developing in the arms of the doll as pressure is alternately applied to and relaxed from the air filled container has its advantages and use. In this respect, when the doll is held to the chest of a child and its arms are flexed about the sides of the child, application by the child of manual pressure over the back of the doll will compress the air filled container. This will pressurize the air within the tubes and force the arms to move, as earlier described, over the body of the child, simulating a gentle stroking and caressing of the child by the doll. Then, as the pressure is relaxed, a corresponding return movement of the doll's arms relative to the body of the child is obtained. This caressing action of the doll's arms over the body of the child will be more pronounced when the air filled container is alternately sharply compressed and relaxed.

It can now be appreciated that the doll of the present invention is not only subject to the usual dressing and other attention normally given by a child to a doll, but it is also usable to advantage for caressing or hugging the child with a feeling of love.

While an embodiment of the invention has been illustrated and described in detail, it is to be expressly understood that the invention is not limited thereto. Various changes of form, design or arrangement may be made in its components without departing from the spirit and scope of the invention. It is my intent, therefore, to claim the invention not only as shown and described but also in all such forms and modifications or equivalents thereof as may reasonably be construed to be within the spirit of the invention and the scope of the appended claims.

What is claimed is:

1. A soft-bodied doll comprising a body, a pair of arms attached to a pair of shoulders and movable relative thereto, the arms and body being formed of soft outer skin material and filled with soft resilient material, and pneumatic means within the body associated with the arms, the pneumatic means being subject to application and relaxation of manual pressure thereon to effect movements of the arms relative to the body, wherein the pneumatic means comprises a soft resilient container within a chest area of the body, a pair of resilient flexible tubes, one of which tubes is connected to and opens at an upper end thereof into a side of the container and extends from it through a shoulder of the doll and down into one of the arms where it terminates at a bottom end of a forearm, and the other one of the tubes similarly is disposed with respect to the other arm at an opposite side of the container, the container and tubes being filled with air and the tubes being sealed at their terminal ends against escape of the air, and the arms and tubes having a normal condition in which upper portions of the arms depend alongside the body and the forearms bend at the elbow to front the body, the container being compressible under manual pressure applied to a back area of the body to pressure air in the tubes to cause them to swell and move the arms upwardly, and the container together with the tubes and arms being returnable to normal condition in response to a relaxing of said pressure.

2. A soft-bodied doll as in claim 1, wherein the doll is adapted to be clasped by a child against her chest and when so held the arms of the doll are adapted to depend alongside the body of the child with the forearms thereof disposed to the rear of the child, and the arms of the doll are adapted in response to pressure alternately applied to and relaxed from the container to move upwardly and downwardly relative to the body of the child.

3. A soft-bodied doll as in claim 1, wherein the soft resilient material filling the body and the arms of the doll supports the position of the container within the body of the doll and surrounds the tubes.

4. A soft-bodied doll as in claim 3, wherein a valve projects from the container externally of the back of the doll and serves as a means whereby air may be pumped to fill the container and the tubes.

5. A soft-bodied doll comprising a body, a pair of arms attached to a pair of shoulders of the body and movable relative thereto, one of the arms depending alongside the body and fronting the body with a forearm and the other arm being similarly disposed at the opposite side of the body, the arms and body being formed of soft skin material and filled with soft resilient material, the doll being adapted to be held against the chest of a child, the arms being adapted while the doll is so held to be flexed about the sides of the child, and pneumatic means within the body of the doll associated with the arms and responsive to application of manual pressure on the pneumatic means to draw the arms of the doll in a caressing movement over the body of the child, wherein the pneumatic means is a resilient and flexible air filled pillow disposed within the body of the doll and having a pair of flexible tubes projecting one from each side thereof and extending one into each of the arms to the end of the forearm, the tubes and pillow being sealed against escape of air to the outside, and the pillow being adapted under application of manual pressure thereon through the back of the doll to pressure air within the tubes so as to cause the tubes and the related arms to move relative to the body of the doll, and wherein the soft resilient material filling the body and arms of the doll supports the position of the pillow within the body of the doll and surrounds the tubes.

* * * * *